US011761248B2

(12) United States Patent
Brickner et al.

(10) Patent No.: US 11,761,248 B2
(45) Date of Patent: Sep. 19, 2023

(54) LATCH FOR A MOTOR VEHICLE

(71) Applicant: Kiekert AG, Heiligenhaus (DE)

(72) Inventors: Robert L. Brickner, Berkley, MI (US); Robert Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 551 days.

(21) Appl. No.: 16/218,736

(22) Filed: Dec. 13, 2018

(65) Prior Publication Data

US 2020/0190864 A1 Jun. 18, 2020

(51) Int. Cl.
*E05B 77/06* (2014.01)
*E05B 79/10* (2014.01)

(52) U.S. Cl.
CPC ..... *E05B 77/06* (2013.01); *E05B 79/10* (2013.01)

(58) Field of Classification Search
CPC ..... E05B 77/02; E05B 77/04; E05B 77/06; E05B 79/10; Y10S 292/22
See application file for complete search history.

(56) References Cited

U.S. PATENT DOCUMENTS

| | | | | |
|---|---|---|---|---|
| 9,732,544 | B2 * | 8/2017 | Wittelsbuerger | E05B 77/06 |
| 2012/0161456 | A1 * | 6/2012 | Riedmayr | E05B 83/24 292/226 |
| 2014/0284944 | A1 * | 9/2014 | Rosales | E05B 85/26 292/113 |
| 2016/0010363 | A1 * | 1/2016 | Wahmann | E05B 77/04 292/92 |
| 2016/0090758 | A1 * | 3/2016 | Bendel | E05B 79/10 292/200 |
| 2017/0107744 | A1 * | 4/2017 | Wilke | E05B 17/0004 |
| 2017/0114574 | A1 * | 4/2017 | Topfer | E05B 77/38 |
| 2018/0195315 | A1 * | 7/2018 | Mozola | E05B 85/10 |
| 2021/0032910 | A1 * | 2/2021 | Fuchs | E05B 79/20 |

FOREIGN PATENT DOCUMENTS

| | | | |
|---|---|---|---|
| DE | 202012007312 | U1 | 11/2013 |
| DE | 202013104118 | | 12/2014 |
| DE | 102014001490 | | 7/2015 |
| DE | 102014002581 | | 8/2015 |
| DE | 102014004552 | A1 | 10/2015 |
| DE | 102017102899 | A1 | 8/2018 |
| WO | 2020121117 | A1 | 6/2020 |

OTHER PUBLICATIONS

Written Opinion dated Feb. 19, 2020, for related International Patent Application No. PCT/IB2019/060387.

* cited by examiner

*Primary Examiner* — Kristina R Fulton
*Assistant Examiner* — Noah Horowitz
(74) *Attorney, Agent, or Firm* — Renner, Otto, Boisselle & Sklar, LLP

(57) ABSTRACT

A latch for a motor vehicle, having a locking mechanism with a catch and at least one pawl, a triggering lever, whereby by means of the triggering lever a locked locking mechanism can be unlocked, an operating lever and a coupling lever, whereby the operating lever can be coupled with the triggering lever dependent on an operating speed of the operating lever by means of the coupling lever and whereby the coupling lever is mounted and guided in the operating lever.

9 Claims, 2 Drawing Sheets

LATCH FOR A MOTOR VEHICLE

Figure 1:
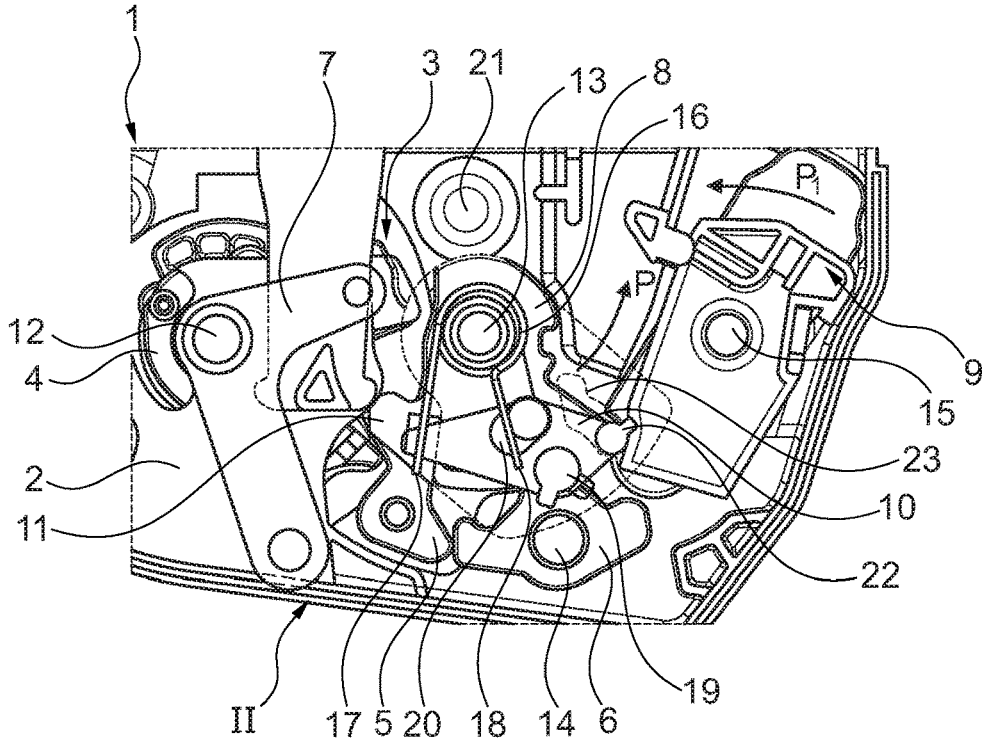

The invention relates to a latch for a motor vehicle, in particular a lateral door latch, having a locking mechanism with a catch and at least one pawl, a triggering lever, whereby by means of the triggering lever a locked locking mechanism can be unlocked, an operating lever and a coupling lever, where the operating lever can be coupled with the triggering lever by means of the coupling lever, dependent on an operating speed of the operating lever.

In latches for motor vehicles, which are also called locking systems, locking mechanisms consisting of a catch and at least one pawl are mostly used. The locking mechanism in the latch interacts with a lock holder which is either attached to the chassis of the motor vehicle or to the door, flap, sliding door, etc. The relative movement between the latch holder and the catch causes the catch to be pivoted and simultaneously for the pawl to engage with the catch.

Depending on the embodiment, there is a one- or two-step locking mechanism which then have a pre-ratcheting and/or a main ratcheting position. The pawl is preferably brought into engagement with the catch via pre-tensioning by a spring. A triggering lever is used for unlocking, i.e. detaching the pawl from the catch. The pawl is acted on by the triggering lever such that the pawl disengages from the catch and the catch moves from the latching position into an opening position. The catch hereby usually moves by means of a spring element and/or due to tensile stress which results from the latch holder in combination with the door seal. An operating lever is used to operate the triggering lever. The operating lever can be an internal operating lever or an external operating lever, for example. The triggering lever is moved and the locking mechanism unlocked with the aid of the operating lever.

To increase safety in motor vehicles, systems are used which are equipped with mass inertia elements. The mass inertia elements counteract an external impulse and prevent a lateral door of a motor vehicle from being opened unintentionally, for example. Such an impulse can be imparted by a collision with another vehicle, for example. If, for example, in the case of a lateral impact a door handle of a lateral door is accelerated and deflected by the initiated impulse, the deflection of the door handle can cause the operating lever to be activated and the locking mechanism to be opened, whereby unintentional opening of the lateral door can occur. In order to prevent such unwanted events and in particular unintentional opening of the lateral door, mass inertia-based locking systems have become known.

A motor vehicle door latch equipped with a mass inertia latch is known from DE 20 2013 104 118 U1 which is. The motor vehicle latch encompasses a bolting arrangement equipped with a control lever and a coupling element. The coupling element has a spring arrangement. In the case of an unoperated operating lever, the bolting arrangement is bolted respectively is only unbolted in a spring-driven manner during operation of the operating lever. If the operating lever is operated with an operating speed occurs greater than a a pre-determined limit speed, the mass inertia of the control lever ensures that the operation of the operating lever occurs in a delayed manner.

A mass inertia-based operating system for a triggering lever has become known from DE 10 2014 001 490 A1. The operating lever interacts with a coupling lever pivotably mounted on the triggering lever. A spring sitting on the operating lever engages on the coupling lever and thus enables the coupling lever to couple during operation of the operating lever. In the coupled state, the locking mechanism can be unlocked by means of the triggering lever. In addition, a bolting lever is provided for by means of which the coupling lever can be uncoupled and also in the case of an inertia-induced accident.

A further mass inertia-based locking system in a latch for a motor vehicle with a separate mass inertia element has become known from DE 10 2014 002 581 A1. A coupling lever is mounted on an operating lever and lies in a position in a spring-tensioned manner in which the coupling lever engages with the triggering lever during operation of the operating lever.

In the case of exceeding a limit speed of the operation of the operating lever, a locking lever acts on the coupling joint so that the coupling joint disengages with the triggering lever. The locking lever in turn abuts a spring pre-tensioned manner on the triggering lever and can follow the movement of the operating lever if the operating lever is operated with a normal operating speed.

In the case of an accident, and thus excessive speed of the operating lever, the control lever cannot follow the movement of the operating lever due to the mass inertia element being engaged with the control lever and engages with the coupling lever. The control lever causes the coupling lever to be deflected. Bolting of the triggering mechanism for the latch can hereby occur by, for example, the mass inertia element being fixed in the deflected state in which the control lever is engaged with the coupling lever so that also during further operation of the operating lever no unlocking of the locking mechanism can occur.

The securing systems known from the state of the art are not convincing in every case. The known mass inertia-based systems partially interact with a spring element. Spring-based systems are subject to fluctuations in the spring constants and/or temperature fluctuations can have an impact on the spring characteristics.

The object of the invention is to provide an improved mass inertia-based operating system for a latch of a motor vehicle. A particular task of the invention is to provide a coupling system working with the simplest constructive means in which the coupling lever can be easily and safely accommodated. Furthermore, a task of the invention is to provide a structurally simple and cost-effective possibility to secure a latch in the case of an accident.

The object is solved according to the invention by the characteristics of the independent patent claim 1. Advantageous embodiments of the invention are stated in the sub-claims. It is pointed out that the exemplary embodiments described hereafter are not restrictive; instead, variations of the characteristics shown in the description, the sub-claims and the drawings are possible.

According to patent claim 1, the object of the invention is solved by a latch for a motor vehicle, in particular a lateral door latch being provided, having a locking mechanism with a catch and at least one pawl, a triggering lever, where by means of the triggering lever a locked locking mechanism can be unlocked, an operating lever and a coupling lever, where the operating lever can be coupled with the triggering lever dependent on the operating speed of the operating lever and where the coupling lever is mounted and guided in the operating lever. By means of the construction of the motor vehicle latch according to the invention, the possibility of providing a motor vehicle latch with integrated mass inertia-based securing from unoperated opening improved with the simplest constructional means is provided. In particular, the mounting of the coupling lever in the operating lever enables construction of the motor vehicle latch with low spatial requirements, which also dispenses with a separate storage point in the motor vehicle latch or, for example, in the housing or latch case of the motor vehicle latch by means of accommodation in the operating lever.

Latch for a motor vehicle means latches which are used, for example, in sliding doors, tailgates, lateral doors, flaps or in covers, such as a top cover. The latch normally encompasses a locking mechanism comprising a catch and at least one pawl. The locking mechanism can be formed with a pre-ratchet and/or a main ratchet, whereby one or two pawls can be used.

A triggering lever is the lever which acts directly on the locking mechanism. The triggering lever acts on the pawl and disengages the pawl from engagement with the catch. A coupling lever acts between the operating lever and the triggering lever. During operation of the operating lever and preferably the external operating lever the coupling lever comes into contact with the triggering lever and thus enables operation of the triggering lever, whereby the locking mechanism can be unlocked. According to the invention, the operating lever has a guidance for the coupling lever provided through mass inertia. For this purpose, the coupling element interacts with a mass inertia element, where the mass inertia element acts on the coupling element in such a way that the mass inertia element deflects the coupling lever along its guide track if the limit speed is exceeded. As a result, the connection between the operating lever and the coupling element is pivoted and uncoupling between the coupling element and the triggering lever is caused.

In an embodiment variant of the invention, the coupling lever is pivotably mounted in the operating lever. Mounting of the coupling lever in the operating lever offers the advantage that work can take place with the least possible number of components to control a mass inertia-based securing system in the motor vehicle latch. The operating lever itself mounts and acts as a storage point for the coupling lever. An extension, in particular a cylindrical extension, preferably protrudes through an aperture in the coupling lever and forms a pivot axis for the coupling lever.

If the coupling lever is guided at least in an aperture, in particular a guide aperture of the coupling lever, a further advantageous embodiment variant of the invention thus results. If the coupling lever has an aperture, in particular a guide aperture, in which the coupling lever is guided, a further function is thus assigned to the operating lever. On the one hand, the operating lever acts as a storage point for the coupling lever and, on the other hand, as a guide for the coupling lever. The coupling lever can, for example, protrude through an aperture of the operating lever so that a pivoting movement of the coupling lever can be controlled and limited in particular. It is naturally also conceivable that the coupling lever only reaches into the aperture of the operating lever in places so that guidance of the coupling lever can be guaranteed. Advantageously, the aperture extends in a circle segment shape around the mounting axis of the coupling lever, so that guidance of the coupling lever along a circular path or a radius can be guided around the mounting axis.

A further embodiment variant of the invention results if the coupling lever is connected to the operating lever at least by means of a positive-locking connection, in particular by means of a bayonet fitting. A positive-locking connection between the coupling lever and the operating lever offers the advantage that the coupling lever can be attached to the operating lever with a minimal number of needed components. The coupling lever can advantageously be formed as a single component and as a plastic component. An extension for guidance and/or mounting of the coupling lever in the operating lever can be molded to the plastic component. By means of molding of a bayonet-type sealing element to an extension of the coupling lever on the one hand a mounting aid and a mounting securing point can be provided for and simultaneously the coupling lever can be undetachably connected to the operating lever. Advantageously, the form fit or the bayonet fitting is formed such on the coupling lever that in an operating position of the coupling lever detachment of the coupling lever from the operating lever can be prevented.

Furthermore, it can be advantageous and constitute a further embodiment variant of the invention if the coupling lever engages with a mass inertia element, where the mass inertia element is mounted in a spring pre-tensioned manner in the motor vehicle latch in the direction of the coupling lever. In interplay with the mass inertia element, the coupling lever forms a securing system for the motor vehicle latch, so that, for example, during unintentional operation of the external door handle with excessive acceleration the mass inertia element can have an uncoupling effect on the coupling element. In particular, the mass inertia element is arranged in the motor vehicle latch such that a lateral impulse on the motor vehicle prevents movement of the mass inertia element, so that the external door handle is not deflected from a starting position.

The mass element can thus counteract the impulse acting on the motor vehicle and by means of the mass inertia element remaining in its starting position fix the coupling lever engaged with the mass inertia element in its unoperated position. In other words, the coupling lever is held by the mass inertia element in its starting position. The mass of the mass inertia element is so large that the coupling element is also not deflected by means of pivoting of the operating lever. The operating lever moves relatively to the coupling lever, so that a pivoting movement occurs between the coupling lever and the operating lever. This deflection or relative movement between the operating lever and the coupling lever leads to the coupling lever being uncoupled and not operating the triggering lever. Unintentional opening is thus prevented.

If an abutment contour of the coupling lever extends, in particular as a cylindrical extension through an aperture of the operating lever, where the extension interacts with a leg spring, in particular a leg of the leg spring, a further embodiment variant of the invention results. By means of the interplay of the coupling lever and the leg spring a position securing of the coupling lever in the operating lever can be provided in a targeted manner. In particular, by means of the force of the leg spring the coupling lever can be held in its starting position in the operating lever. By means of the interplay of the leg spring, coupling lever and mass inertia element a safe and reliable mass inertia system can then be provided which in interplay provides unintentional opening of the motor vehicle latch.

If the leg spring is mounted around a common axis with the operating lever and/or the convenience pawl and/or the coupling lever in the motor vehicle, a further embodiment variant of the invention advantageously results. By means of the common mounting of the leg spring with other components of the motor vehicle latch and in particular the mass inertia chain, a space-saving configuration of the mass inertia system can be attained. In particular, a cost-effective accommodation can thus be provided for the leg spring.

If a leg of the leg spring also engages with the operating lever, a further configuration variant of the invention thus results. In particular by means of the abutment of a leg of the leg spring on the operating lever and advantageously on an abutment contour of the coupling lever position securing can be achieved for the coupling lever in the operating lever with a minimal number of needed components. Advantageously, the single leg spring can determine the spring constant with which the mass inertia element can be deflected, whereby the limit speed and the force for deflection of the mass inertia element can be determined and set in a defined manner, so that safe functioning of the mass inertia-based system can be attained.

If the coupling lever has a contour, in particular an abutment contour in the form of a recess, where a cylindrical extension of the coupling lever can be engaged with the contour, a further embodiment variant of the invention results. The coupling lever is preferably formed as a plastic component or can be formed as a composite material component, for example, having a metallic core within a plastic sheathing. The cylindrical extensions, contours or abutment contours can thus advantageously be formed as plastic extensions or contours on the coupling lever. If a cylindrical extension engages into the coupling lever in a positive-locking manner, secure interplay can be achieved between the coupling lever and the triggering lever. The coupling lever can engage into the contour of the triggering lever by means of the cylindrical extension, whereby a position securing can be attained for the coupling lever during operation of the triggering lever simultaneously.

It can also be advantageous if the coupling lever can be disengaged with the triggering lever dependent on an operating speed of the operating lever and in interaction with the mass inertia element. In this form of interplay of the operating speed of the operating lever with the mass inertia element and the leg spring the operating lever can be disengaged from the triggering lever. A securing system can hereby be provided with which operation of the triggering lever can also be securely prevented with a strong impulse on the motor vehicle and operation of the external or internal operating triggering chain.

Hereinafter the invention is explained in further detail with reference to the attached drawings on the basis of a preferred exemplary embodiment. However, the principle applies that the exemplary embodiments do not restrict the invention, but only constitute advantageous embodiments. The characteristics portrayed can be executed individually or in combination with other characteristics of the description and also the patent claims individually or in combination.

THE FOLLOWING ARE SHOWN

Figure 2:
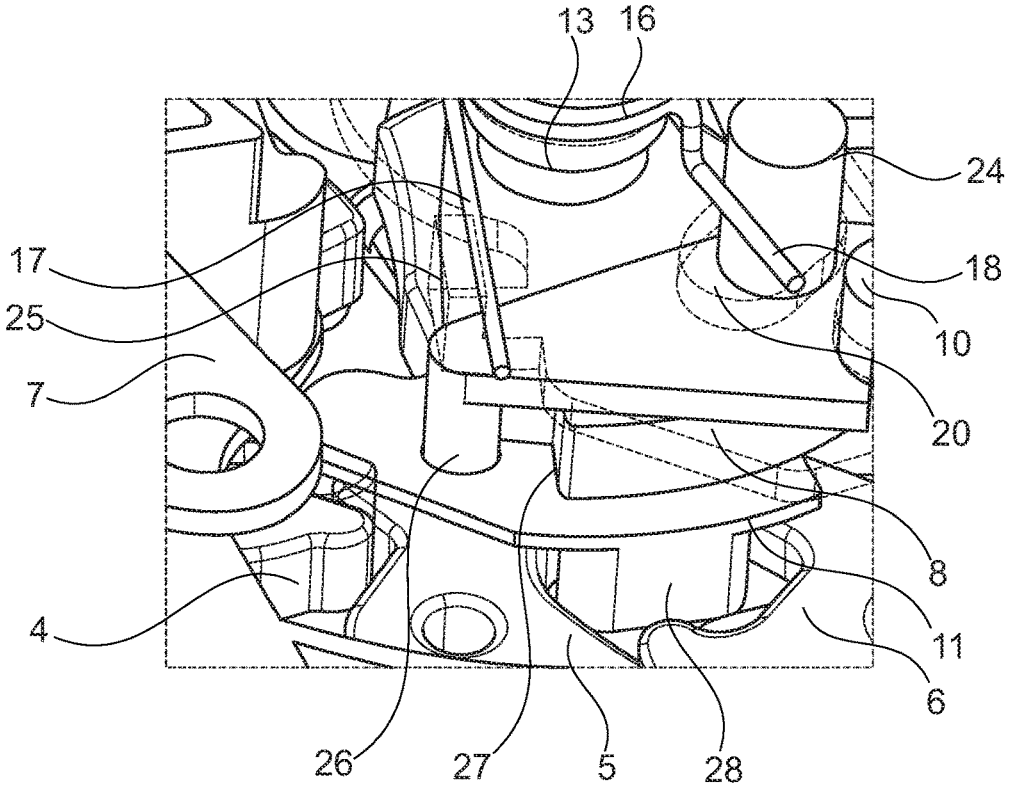
Figure 3:
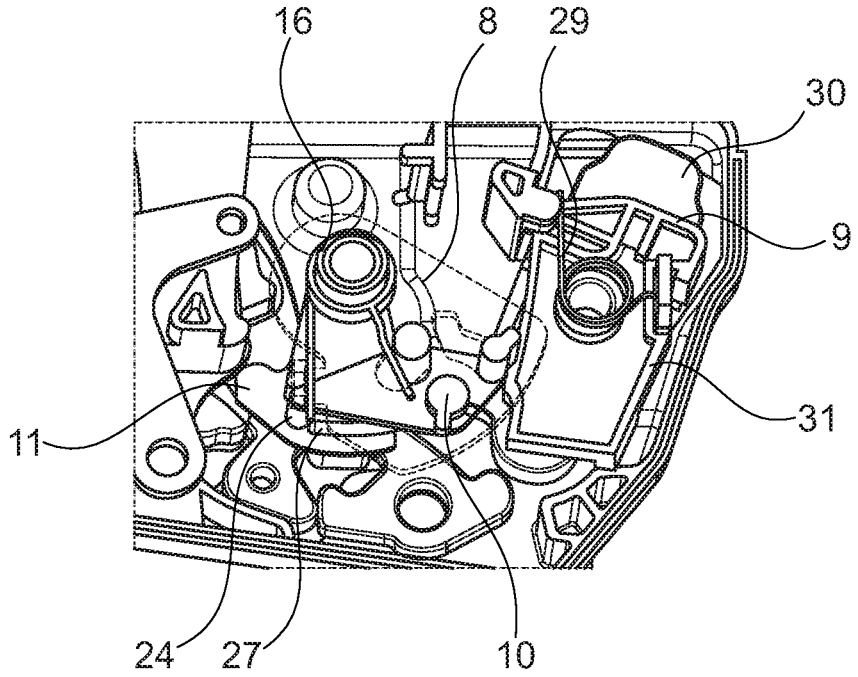
Figure 4:
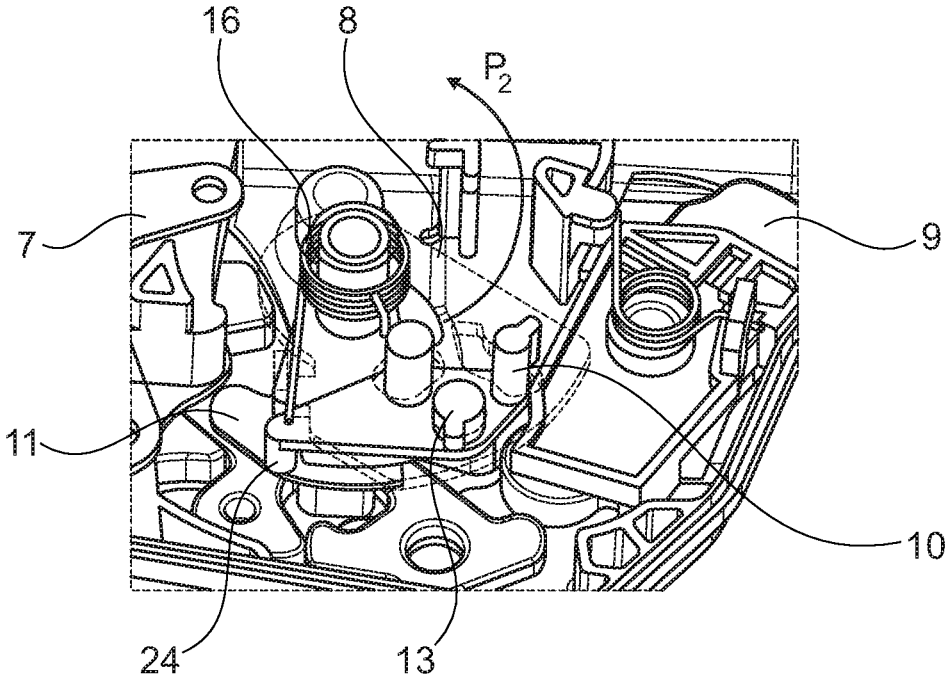

FIG. 1 a top view of a motor vehicle latch formed according to the invention, where the motor vehicle latch is shown in an open position and where only the crucial operating elements for explanation of the invention are illustrated and the motor vehicle latch is reproduced in a locked position and unoperated, FIG. 2 a detailed view of the motor vehicle latch according to FIG. 1 from the direction of the arrow II, whereby in particular the engagement relationships between the coupling lever and the triggering lever are reproduced in an enlarged depiction, FIG. 3 a view of the motor vehicle latch according to FIG. 1, where the operating lever is reproduced in a deflected position, i.e. a nascent unlocking of the locking mechanism in the case of operation of the operating lever with a normal speed, and FIG. 4 the position of the coupling lever with excessively strong acceleration of the operating lever and deflection of the coupling lever.

In FIG. 1, a motor vehicle latch 1 is shown in a top view of an open housing 2. A locking mechanism 3 consisting of a catch 4, a first pawl 5, which is also called a convenience pawl 5, and a pawl 6 is accommodated in the housing. Additionally, FIG. 1 shows an external operating lever 7, an operating lever 8, a mass inertia element 9, a coupling lever 10 and a triggering lever 11.

In this exemplary embodiment, the catch 3 and the external operating lever 7 are mounted around a common axis 12 and the operating lever 8, the pawl 5 and the triggering lever 11 are pivotably mounted around a common axis 13 in the motor vehicle latch 1. The pawl 6 and the mass inertia element 9 are respectively accommodated around separate axes 14, 15, and are also mounted pivotably in the motor vehicle latch 1. A leg spring 16 extends around the axis 13 abuts with a leg 17 the operating lever 8 and with a further leg 18 the coupling lever 10. The coupling lever 10 is in turn pivotably accommodated around an axis 19 in the operating lever 8. The coupling lever can be pivoted against the force of the leg spring 16 and in particular against the spring leg 18 of the leg spring 16 in this exemplary embodiment around the axis 19 in the anti-clockwise direction in places. Pivoting of the coupling lever 10 is possible in the area of the guide aperture 20 of the operating lever 8. For operation of the coupling lever 10 and pivoting around the axis 19 the coupling lever must be moved against the force of the spring leg 18, as explained in further detail hereafter.

The motor vehicle latch 1 is shown in FIG. 1 in a locked position of the locking mechanism 3. The catch 4 is engaged with the convenience pawl 5 and in particular in a main latching position so that the catch 4 is locked in a movement direction in an anti-clockwise direction. The convenience pawl 5 is in turn held in engagement with the catch 4 by means of the pawl 6. Due to the use of two pawls 5, 6 this type of construction of a locking mechanism 3 is also named a double pawl locking mechanism. The operating lever 8 must be operated in the direction of the arrow P to unlock the locking mechanism 3. The operation of the operating lever 8 takes place by means of the external operating lever 7, for example, where the connecting element is accommodated between the external operating lever 7 and the operating lever 8, in this example on the protrusion 21 of the housing 2. If the external operating lever 7 is now operated, the operating lever pivots in the direction of the arrow P. By means of the leg spring 16 and the coupling lever 10 the triggering lever 11 is now also pivoted in the direction of the arrow P in an anti-clockwise direction and the pawl 6 and the convenience pawl 5 are disengaged. An opening force acting on the catch 4 which, for example, can result from a door seal, then pivots the catch 4 in an anti-clockwise direction so that a latch holder held by the catch 4 is released and the door or flap can be opened.

The illustrated course of the opening process of the locking mechanism 3 is connected to a pivoting movement of the mass inertia element 9. The mass inertia element 9 is also engaged with the coupling lever 10 so that during operation of the operating lever 8 the mass inertia element 9 is pivoted in the direction of the arrow P1 in an anti-clockwise direction around the axis 15. The mass inertia element 9 abuts the coupling lever 10 in a spring pre-tensioned manner in the direction towards the coupling lever. During customary, i.e. normal operating speed of the operating lever 8 the force of the leg spring 16 is sufficient to hold the coupling lever 10 in the position illustrated in FIG. 1, so that the mass inertia element 9 is deflected.

Only for the purposes of clarification it is pointed out that extensions 22 are arranged on the coupling lever 10 which extend through apertures of the operating lever 8. These extensions 22 in combination with the apertures 23 form a mounting option for the coupling lever 10, where by means of the extensions and the formation of the apertures 23 a bayonet-type connection is attained between the operating lever 8 and the coupling lever 10.

In FIG. 2, an enlarged view of the engagement area of the coupling lever 10 into the triggering lever 11 and the interplay of the coupling lever 10 with the leg spring 16 is shown. The leg spring 16 abuts, as clearly apparent in FIG. 2, with a spring leg 18 on a first cylindrical extension 24 of the coupling lever 10. A further spring leg 17 of the leg spring 16 is engaged with a splay 25 of the operating lever 8. The leg spring 16 is configured as a splay spring, so that the coupling lever 10 is held in a spring pre-tensioned manner in the aperture 20 of the operating lever 8 and in FIG. 2 to the right in the aperture 20. If the operating lever 8 is now pivoted around the axis 13 in an anti-clockwise direction, a further cylindrical extension 26 thus engages with a contour 27 of the triggering lever 11. An extension 28 on the triggering lever can move the pawl 6 and a further extension on the triggering lever 11 can ultimately disengage the convenience pawl 5 with the catch, should the convenience pawl 5 not independently move out of the engagement area with the catch.

The extension 26 on the coupling lever 10 only engages with the contour 27 if the operating lever 8 is operated with a customary speed, i.e. a normal operating speed. This is shown in FIG. 3. The leg spring 29 acting on the mass inertia element 9 is also depicted in FIG. 3. The leg spring 29 exerts a spring force on the mass inertia element in a clockwise direction so that the mass inertia element is present in a spring pre-tensioned manner in the direction of the coupling lever 9. The mass inertia element can, as illustrated in this exemplary embodiment, can be a two-part construction, wherein a first metallic mass component 30 and a plastic component 31 surrounding the first metallic mass element 30 can be provided for. As clearly apparent in FIG. 3, the cylindrical extension 24 abuts the contour 27 of the triggering lever 11 so that by means of the operating lever 8 and with the aid of the coupling lever 10 the triggering lever 11 can be pivoted. With the operating lever 8 operated at a customary operating speed the force of the leg spring 16 is sufficiently large to pivot the mass inertia element 9 against the force of the leg spring 29. A spring force of the leg spring 16 is chosen in such a way that during the customary operating speed the leg spring 16 remains rigid and the coupling lever 10 presses simultaneously on the operating lever 8 and on the mass inertia element 9, so that the coupling lever 10 is taken along by the operating lever 8 and simultaneously deflects the mass inertia element 9, so that the operating lever 8 can be pivoted around further. In other words, the leg spring 16 holds the coupling lever 10 in an operating position for the triggering lever 11. The locking mechanism 3 can thus be opened.

In FIG. 4, the state is now shown which occurs when the operating lever 8 is operated with an excessive speed by means of the external operating lever 7, for example, in the direction of the arrow P2. Due to the high speed of the operating lever 8 the spring force of the leg spring 16 is insufficient in order to deflect the mass inertia element 9 during impingement of the coupling lever 10 on the mass inertia element 9, taken along by the operating lever 8, instead the leg spring 16 is compressed. Due to the compression of the leg spring 16 the coupling lever 10 can move with its extensions 22 within the apertures 23 in the operating lever 8 and it can pivot around its axis 13. By means of compression of the leg spring 16 and collision with the mass inertia element 9, which cannot follow the operating lever 8 with its high speed due to its higher mass inertia compared to the operating lever 8 the coupling lever 10 is pivoted around the axis 13. The cylindrical extension 24 disengages from the triggering lever 11 during this pivot. Coupling between the operating lever 8 and the triggering lever 11 is thus interrupted, so that opening of the locking mechanism or unlocking of the locking mechanism is prevented when the operating lever 8 is subjected to excessive accelerations. Advantageously, by means of the construction of the motor vehicle latch according to the invention and in particular by means of mounting and guidance of the coupling lever 10 in the operating lever a space-saving and structurally beneficial solution to generate a mass inertia-based coupling system can be provided for a motor vehicle latch. Furthermore, a securely accommodated coupling system can be provided for with the least possible number of components.

REFERENCE SIGN LIST

1 Motor vehicle door latch
2 Housing
3 Locking mechanism
4 Catch
5 Convenience pawl
6 Pawl
7 External operating lever
8 Operating lever
9 Mass inertia element
10 Coupling lever
11 Triggering lever
12, 13, 14, 15, 19 Axis
16, 29 Leg spring
17, 18 Spring leg
20 Guide aperture
21 Elevation
22 Extensions
23 Apertures
24, 26 Cylindrical extension
25 Splay
27 Contour
28 Extension
30 Metallic mass element
31 Plastic component
P, P1, P2 Arrow

The invention claimed is:

1. A motor vehicle latch comprising:

a locking mechanism;

a triggering lever provided for unlocking the locking mechanism;

an operating lever provided for operating the triggering lever, wherein the operating lever moves about a first axis;

a coupling lever provided for coupling and decoupling the operating lever to the triggering lever dependent on an operating speed of the operating lever, wherein the coupling lever is mounted and guided in the operating lever by way of an extension that extends from a first side of the coupling lever through an aperture of the operating lever, wherein when the operating lever is operated with a normal operating speed, the coupling lever and the operating lever are coupled for movement together, and the coupling lever is moved by the operating lever so that a second extension of the coupling lever that extends from a second side of the coupling lever opposite the first side abuts the triggering lever to couple the coupling lever the triggering lever for unlocking the locking mechanism via the operating lever, and wherein when the operating lever is operated with an excessive operating speed that is greater than the normal operating speed, the coupling lever moves about a second axis to rotate the extension of the coupling lever away from engagement with the triggering lever to uncouple the coupling lever and the triggering lever for preventing unlocking the locking mechanism via the operating lever, wherein the second axis is different from the first axis; and a mass inertia element that is mounted separately from the coupling lever and is engageable with the coupling lever, wherein the mass inertia element is spring biased clockwise about a third axis, wherein the third axis is different from the first axis and the second axis, wherein during the normal operating speed of the operating lever, the coupling lever rotates the mass inertia element counterclockwise about the third axis against the spring bias, and wherein during the excessive operating speed of the operating lever, the mass inertia element is configured to hold the coupling lever in a starting position.

2. The motor vehicle latch of claim 1, wherein the coupling lever is pivotably mounted in the operating lever.

3. The motor vehicle latch of claim 1, wherein the coupling lever is connected to the operating lever by a positive-locking connection.

4. The motor vehicle latch of claim 3, wherein the positive-locking connection is a bayonet fitting.

5. The motor vehicle latch of claim 1, wherein the triggering lever has a contour in the form of a recess, wherein the contour of the triggering lever is provided for engaging the second extension of the coupling lever.

6. The motor vehicle latch of claim 5, wherein the coupling lever has a third extension and the aperture of the operating lever includes two apertures for guiding the extension and the third extension of the coupling lever.

7. The motor vehicle latch of claim 1, wherein the second extension is a cylindrical extension.

8. The motor vehicle latch of claim 1, wherein the coupling lever is disengaged from the triggering lever by the mass inertia element during the excessive operating speed of the operating lever.

9. The motor vehicle latch of claim 1, wherein the mass inertia element is formed of a first metallic mass component and a plastic component surrounding the first metallic mass component.

* * * * *